US007341483B2

(12) United States Patent
Reker

(10) Patent No.: US 7,341,483 B2
(45) Date of Patent: Mar. 11, 2008

(54) PROTECTIVE SLEEVE ARRANGEMENT FOR ELECTRICAL CONNECTORS

(75) Inventor: Stefan Reker, Bielefeld (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 11/179,448

(22) Filed: Jul. 12, 2005

(65) Prior Publication Data

US 2006/0025000 A1 Feb. 2, 2006

(30) Foreign Application Priority Data

Jul. 29, 2004 (DE) ..... 20 2004 011 880 U

(51) Int. Cl.
*H01R 13/40* (2006.01)

(52) U.S. Cl. ..... 439/587; 439/369

(58) Field of Classification Search ..... 439/281, 439/552, 252, 553, 246–248, 578–585, 736, 439/209, 535, 320, 638, 211, 650–654, 587–589, 439/369

See application file for complete search history.

(56) References Cited

U.S. PATENT DOCUMENTS 5,556,292 A * 9/1996 Kato et al. ..... 439/218
5,746,617 A * 5/1998 Porter et al. ..... 439/248
6,045,402 A * 4/2000 Embo et al. ..... 439/579
6,149,461 A * 11/2000 Emery ..... 439/578
6,174,206 B1 1/2001 Yentile et al.
6,431,912 B1 * 8/2002 Mori ..... 439/587
6,447,327 B2 9/2002 Shimogama
6,527,599 B2 * 3/2003 Bechtold et al. ..... 439/736

FOREIGN PATENT DOCUMENTS

DE 101 60 910 A1 5/2003
EP 1 251 595 A1 10/2002

* cited by examiner

*Primary Examiner*—Edwin A. Leon
(74) *Attorney, Agent, or Firm*—Lawrence E. Laubscher, Sr.; Lawrence E. Laubscher, Jr.

(57) ABSTRACT

An electrical distributor assembly includes a plug member connected with a socket member that is mounted on, and extends slightly above, the top surface of a distributor housing, characterized by the provision of an axially displaceable protective sleeve mounted concentrically about the plug and socket members. The plug includes an upwardly extending integral cable supporting portion that is also enclosed by the sleeve.

8 Claims, 1 Drawing Sheet

1
2
2
2a
3
4
5
6
6
8
9
11
11
C 8
9
10
7
5
6
11
2
2a
l
d

PROTECTIVE SLEEVE ARRANGEMENT FOR ELECTRICAL CONNECTORS

BACKGROUND OF THE INVENTION

1. Field of the Invention

An electrical distributor assembly includes a plug member connected with a socket member that is mounted on, and extends slightly above, the top surface of a distributor housing, characterized by the provision of an axially displaceable protective sleeve mounted concentrically about the plug and socket members. The plug includes an upwardly extending integral cable supporting portion that is also enclosed by the sleeve.

2. Description of the Related Art

This invention relates to a distributor arrangement for supplying electrical energy from cable conductors to the sensing and actuating components of an automated building structure, including a distributor housing that is provided with a plurality of sockets connected with various the building components, and a plurality of plugs that are connected with the supply cables, respectively.

Such arrangements are well known in the prior art, as shown, for example, by the Yentile et al U.S. Pat. No. 6,174,206, and the European Published Applicaton No. 1,251,595. In general, the power supply cables are connected to the field bus subscribers by socket members that at their ends facing the distributor have a corresponding plug member. Although these arrangements generally proved to be effective as such, it was nevertheless, discovered that under extremely rough environmental conditions, a rupture often occurs of the coupling between the plug and socket members, or of the cable in the area of connection to the plug member.

Accordingly, in keeping with the present invention, there is provided a protective sleeve that is axially displaceable to concentrically enclose the coupled plug and socket members, which sleeve preferably extends over the entire axial length of the plug and socket assembly. In this manner, with a simple effort in terms of design, one can ensure a particularly stable protection for the coupling consisting of the socket and plug members mounted on the distributor housing.

BRIEF SUMMARY OF THE INVENTION

Accordingly, a primary object of the present invention is to provide a distributor arrangement in which a socket member is mounted on the top face of a distributor housing, a plug member is mounted upon the socket member with contacts on the plug member in engagement with corresponding contacts on the socket member, and a protective sleeve is mounted concentrically about the plug and socket assembly. The inner diameter of the sleeve corresponds with the outer diameter of the socket member, whereby the sleeve is at least partially supported by its engagement with the circumferential surface of the socket member.

According to a more specific object of the invention, the socket member is supported on the distributor body by a pair of cylindrical support members. The upper first support member has a diameter that corresponds with the inner diameter of the sleeve, whereby the sleeve engages and is at least partially supported on the distributor housing by the outer circumferential surface of the upper support member. The lower support member has an outer diameter that is greater than the inner diameter of the sleeve, whereby the lower support member serves as an abutment or stop for limiting the downward movement of the sleeve relative to the plug and socket assembly. The length of the sleeve is such that when the lower end of the sleeve engages the lower support member, the upper end of the sleeve terminates opposite the upper extremity of a cable supporting portion that extends axially upwardly from the plug.

BRIEF DESCRIPTION OF THE DRAWINGS

Other objects and advantages of the invention will become apparent from a study of the following specification when viewed in the light of the accompanying drawings, in which.

DETAILED DESCRIPTION OF THE INVENTION

Figure 1:
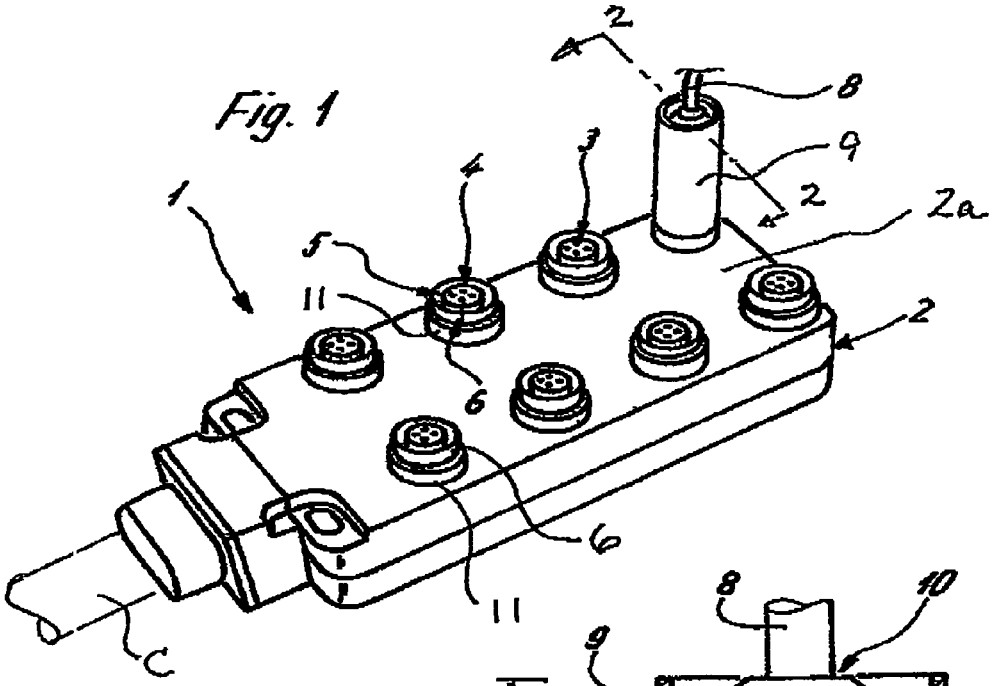
FIG. 1 is a top front perspective view of the distributor apparatus of the present invention.

Referring first more particularly to FIG. 1, the distributor apparatus 1 includes a distributor housing 2 having a top surface 2*a* upon which are mounted a plurality of electrical connectors 3 and 4 having cylindrical socket members 5 that are adapted for connection with the various sensors or actuators of an automated building system via cables 8, and to the main control panel by the distributor cable means C. The connections provided by the contacts 3 and 4 are of the so-called "M-standard" type, such as M5 connections, M6 connections, M12 connections, and so forth. Each of the socket members 5 is supported a given distance d (FIG. 2) from the distributor body top surface 2*a* by upper first and lower second cylindrical support members 6 and 11, respectively. This distance d is on the order of several millimeters, and is preferably greater than 3 mm. As is common with the M-standard type connections, a nut (not shown) may be provided for firmly connecting the plug member 7 to the socket member 5. The socket support members 6 and 11 are preferably formed from a conventional synthetic plastic electrical insulating material.

Mounted on the socket members 5 are plug members 7 having electrical contacts that engage corresponding contacts 3 and 4 on the socket members. The contacts of each plug member are connected with the corresponding conductors of a cable 8 that extends upwardly from the plug via an axially extending integral cable supporting plug portion 10. The plug and socket members are preferably formed from a suitable electrically insulating synthetic plastic material, as is known in the art.

Figure 2:
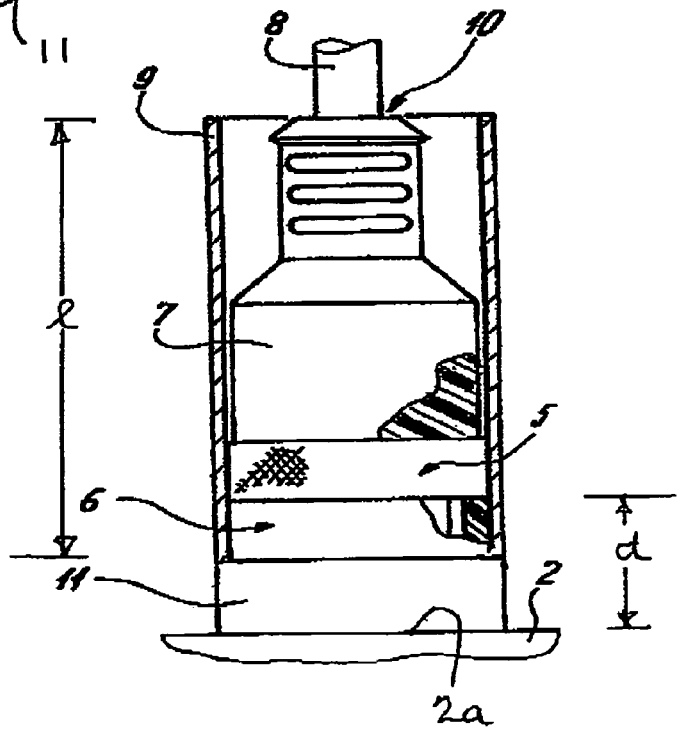
FIG. 2 is a sectional view taken along line 2-2 of FIG. 1.

As best shown in FIG. 2, according to a characterizing feature of the present invention, a rigid protective sleeve 9 is provided that is axially displaceable to a position concentrically enclosing the assembled plug and socket members. More particularly, the sleeve 9, which is preferably formed of metal, has an inner diameter that corresponds with the outer diameter of the upper socket support member 6. Thus, when the sleeve is axially displaced relative to the socket member, the sleeve will slidingly engage the outer circumferential surface of the upper socket support member, thereby to firmly connect the two members together in a stable manner, with the sleeve being supported by the socket support member. The outer diameter of the cylindrical plug member 7 is slightly less than the inner diameter of the sleeve 9, and the plug cable supporting portion 10 has an outer diameter that is appreciably less than that of the inner diameter of the sleeve 9. The lower support member 11 has a diameter that is greater than the inner diameter of the sleeve 9, whereby when the sleeve is mounted to protectively enclose the connected plug and socket members, the lower end of the sleeve abuts and is seated on the upper end of the lower support member 11. The length l of the sleeve is such that the upper end of the sleeve 9 terminates precisely adjacent the upper extremity of the cable supporting portion 10 of the plug member. In this manner, nicking of the cable outer insulation layer by the protective sleeve 9 is avoided.

While in accordance with the provisions of the Patent Statutes the preferred forms and embodiments of the invention have been illustrated and described, it will be apparent to those skilled in the art that various changes may be made without deviating from the inventive concepts set forth above.

What is claimed is:

1. Electrical distributor apparatus including connector protecting means, comprising:

(a) a rectangular distribution housing (2) having a horizontal top surface (2*a*);

(b) a cylindrical socket member (5) having a vertical longitudinal axis, and an outer circumferential surface defining a socket diameter;

(c) support means supporting said socket member in spaced relation above said housing top surface, said support means including:

(1) a cylindrical first support member (6) arranged colinearly relative to said socket member between said socket member and said housing top surface, (2) said first support member having an outer circumferential surface with a diameter that is at least as large as the diameter of said socket member;

(d) a cylindrical plug member (7) mounted colinearly on said first support member, said plug member having a lower end provided with a plurality of plug contacts in engagement with corresponding socket contacts on the upper end of said socket member, respectively;

(e) a cable (8) extending from the upper end of said plug member, said cable including a plurality of conductors connected with said plug contacts, respectively; and (f) a vertical axially displaceable rigid tubular protective sleeve (9) having a lower end portion extending concentrically about, and slidably connected with, said first support member outer circumferential surface, (1) said sleeve being open-ended and having throughout its length a uniform internal diameter that is equal to said first support member given diameter;

(2) said sleeve extending upwardly concentrically about the assembled plug and socket members, (3) said sleeve being axially displaceable relative to said housing, said socket member, said first support member, and said plug member.

2. Distributor apparatus as defined in claim 1, wherein the outer diameter of said plug member is less than the inner diameter of said sleeve.

3. Distributor apparatus as defined in claim 1, wherein said socket member includes an end surface adjacent said plug that is spaced by a distance (d) of at least 3 mm above said distributor body top surface.

4. Distributor apparatus as defined in claim 1, wherein said sleeve is formed from metal.

5. Distributor apparatus as defined in claim 1, wherein said support means includes a second support member (11) arranged between said housing top surface and said first support member, said second support member including a horizontal upper surface having at least one transverse horizontal dimension that is greater than the internal diameter of said protective sleeve, said protective sleeve having a lower extremity in abutting seated engagement with said second support member upper surface.

6. Distributor apparatus as defined in claim 5, wherein said plug member includes at one end remote from said socket member an axially extending cable supporting portion (10) having a reduced outer diameter and terminating at a free extremity, said sleeve having a length (l) such that the upper end extremity of said sleeve terminates opposite said free extremity of said cable supporting portion.

7. Electrical distributor apparatus including connector protecting means, comprising:

(a) a rectangular distribution housing (2) having a horizontal top surface (2*a*);

(b) a cylindrical socket member (5) having a vertical longitudinal axis, and an outer circumferential surface defining a socket diameter;

(c) support means supporting said socket member in spaced relation above said housing top surface, said support means including:

(1) a cylindrical first support member (6) arranged colinearly relative to said socket member between said socket member and said housing top surface, said first support member having an outer circumferential surface with a diameter that is at least as large as the diameter of said socket member; and (2) a second support member (11) arranged between said housing top surface and said first support member, said second support member having a horizontal upper surface the transverse dimensions of which are greater than said first support member given diameter;

(d) a cylindrical plug member (7) mounted colinearly on said first support member, said plug member having a lower end provided with a plurality of plug contacts in engagement with corresponding socket contacts on the upper end of said socket member, respectively;

(e) a cable (8) extending from the upper end of said plug member, said cable including a plurality of conductors connected with said plug contacts, respectively; and (f) a vertical axially displaceable rigid tubular protective sleeve (9) having a lower end portion extending concentrically about and slidably connected with said first support member outer circumferential surface, (1) said sleeve being open-ended and having throughout its length a uniform internal diameter that equals said first support member given diameter;

(2) said sleeve extending upwardly concentrically about the assembled plug and socket members, (3) said sleeve being axially displaceable relative to said housing, said socket member, said first support member, and said plug member, (4) said sleeve having a lower extremity seated on the upper surface of said second support member.

8. Electrical distributor apparatus as defined in claim 7, wherein said plug member includes at its upper end a cable support portion (10) that extends concentrically around the adjacent portion of said cable; and further wherein:

(5) said sleeve has an upper extremity that terminates adjacent the upper extremity of said plug member cable support portion.

* * * * *